US006050790A

United States Patent [19]

Chen

[11] Patent Number: 6,050,790

[45] Date of Patent: Apr. 18, 2000

[54] ELECTRIC WAVING FAN WITH OSCILLATING MULTI-DIRECTION FAN VANE ELEMENT

[76] Inventor: Qian-Shan Chen, P.O. Box 1245, Rosemead, Calif. 91770

[21] Appl. No.: 09/002,123

[22] Filed: Dec. 31, 1997

Related U.S. Application Data

[60] Provisional application No. 60/059,600, Sep. 23, 1997.

[51] Int. Cl.[7] ..... F04B 19/00

[52] U.S. Cl. ..... 417/436; 417/423.6; 417/481; 416/100; 416/169 R

[58] Field of Search ..... 417/423.6, 436, 417/481, 410.1, 44.1; 416/100, 169 R

[56] References Cited

U.S. PATENT DOCUMENTS

| | | | |
|---|---|---|---|
| 850,226 | 4/1907 | Holladay | 416/100 |
| 2,372,621 | 3/1945 | Williams | 417/436 |
| 2,523,197 | 9/1950 | Daland | 170/135.2 |
| 2,618,434 | 11/1952 | Farnsworth | 416/100 |
| 3,625,633 | 12/1971 | Nelson | 416/169 R |
| 4,068,156 | 1/1978 | Johnson et al. | 318/575 |
| 4,068,763 | 1/1978 | Fletcher et al. | 414/4 |
| 4,273,506 | 6/1981 | Thomson et al. | 414/735 |
| 4,326,837 | 4/1982 | Gibson et al. | 417/12 |
| 4,732,539 | 3/1988 | Shin-Chin | 416/100 |
| 4,734,012 | 3/1988 | Dob et al. | 417/32 |
| 5,075,606 | 12/1991 | Lipman | 318/254 |
| 5,256,039 | 10/1993 | Crawford | 417/234 |
| 5,307,447 | 4/1994 | Asano et al. | 395/90 |
| 5,556,256 | 9/1996 | Shao | 416/100 |

OTHER PUBLICATIONS

Tom Frampton, Punkah Wall Fan Assembly, Dec. 1981, 9 pages. (www.fanimation.com/punkah–w.html).

*Primary Examiner*—Charles G. Freay
*Assistant Examiner*—Robert Z. Evora
*Attorney, Agent, or Firm*—Raymond Y. Chan; David & Raymond

[57] ABSTRACT

An electric waving fan includes a single air moving fan vane element, a motor for generating power, a transmission apparatus for converting the power to motion, and a power output assembly for moving the single fan vane element simultaneously in two directions such that the fan vane element moves with a waving motion. The fan further includes a base and a wrist assembly that can be moved in two directions relative to the base which can be mounted on a wall, on the floor or desk, or hang from the ceiling.

23 Claims, 11 Drawing Sheets

ELECTRIC WAVING FAN WITH OSCILLATING MULTI-DIRECTION FAN VANE ELEMENT

CROSS REFERENCE OF RELATED APPLICATION

This is a regular application of a provisional application, filed Sep. 23, 1997, provisional application Ser. No. 60/059,600.

BACKGROUND OF THE INVENTION

1. Field of Invention

The present invention relates generally to air moving devices, such as fans and the like, and more particularly to an electric waving fan combining mechanical and electronic control mechanisms to produce a novel waving motion that imitates movements of the human hand and wrist to thereby provide cooling breezes.

2. Description of Related Arts

Conventional electric fans typically comprise a housing supporting a motor and three or more revolving vanes connected to the main axle of the motor at a hub. When actuates, the motor causes rotation of the axle, and hence the vanes, at high speed to produce a wind.

Conventional electric fans have various drawbacks. First, such fans are not safe, and pose significant danger to small children who are drawn toward, and try to touch, the rotating vanes through the fan cage. Second, the wind produced by these fans are often too strong and unnatural. Third, because in such fans, the casing must protect and enclose the rotating vanes, the casings are not terribly aesthetically pleasing, and typically the casings are not harmonious in an elegant room. Finally, electric fans that are mounted on the walls, or suspended from ceilings, often have exposed vanes that revolve at high speed and pose grave danger to those in the near vicinity should they come into contact with the vanes.

SUMMARY OF THE PRESENT INVENTION

It is therefore an object of the present invention to provide an a ir moving apparatus that is safe, aesthetically pleasing, and provides soothing and pleasant wind flow patterns, while overcoming the disadvantages and shortcomings of other known air moving apparatus.

Another object of the present invention is to provide a fan apparatus having vanes means, a movable base, and a motion producing assembly capable of driving the base and vane means with movements that emulate movements of a human hand and wrist, thereby creating wind patterns that fluctuate in velocity and direction.

Another object of the present invention is to provide a fan device driven by mechanical and electronic control systems, in which air is moved by a single vane element in several directions about two axes during the course of operation.

Still another object of the invention is to provide a fan apparatus which is compact and safe to use. Unlike fans of conventional design where the vane elements revolve at high speed and comprise hard, unyielding blades, the fan of the present invention possesses only a single, soft, vane element, and does not require a supporting frame of dimension greater than the diameter of motion of the vane element.

Theses and other objects of the invention are achieved by a fan apparatus according to the present invention which preferably includes a single, soft, blade element driven in undulating motion by mechanical and electronic control and drive mechanisms, the details of which are presented in great detail below.

BRIEF DESCRIPTION OF THE DRAWINGS

The objects and features of the present invention described generally above, which are believed to be novel, are set forth with particularity in the appended claims. The present invention, together with further objects and advantages, may best be understood by reference to the detailed description that follows, and the appended drawings in which:

DETAILED DESCRIPTION OF THE PREFERRED EMBODIMENT

The following description is provided to enable any person skilled in the art to make and use the invention and, with reference to the drawings, sets forth the best mode contemplated by the inventor of carrying out this invention.

Figure 1:
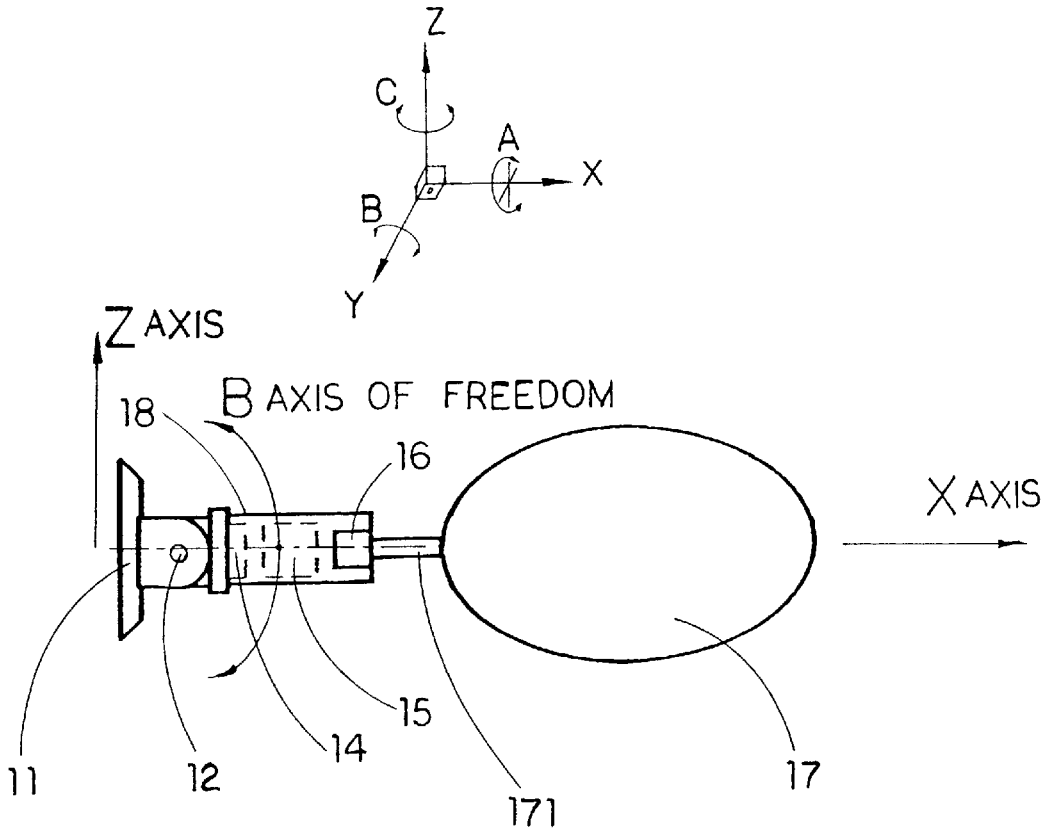
FIG. 1 is a side view of the principal structural elements of the fane assembly of the present invention.
Figure 2:
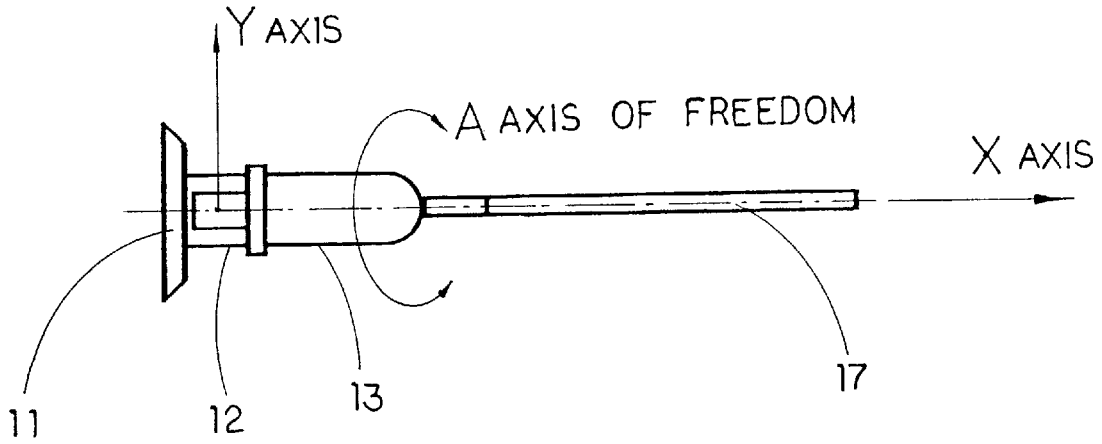
FIG. 2 is a top view of the fan assembly shown in FIG. 1.
Figure 3:
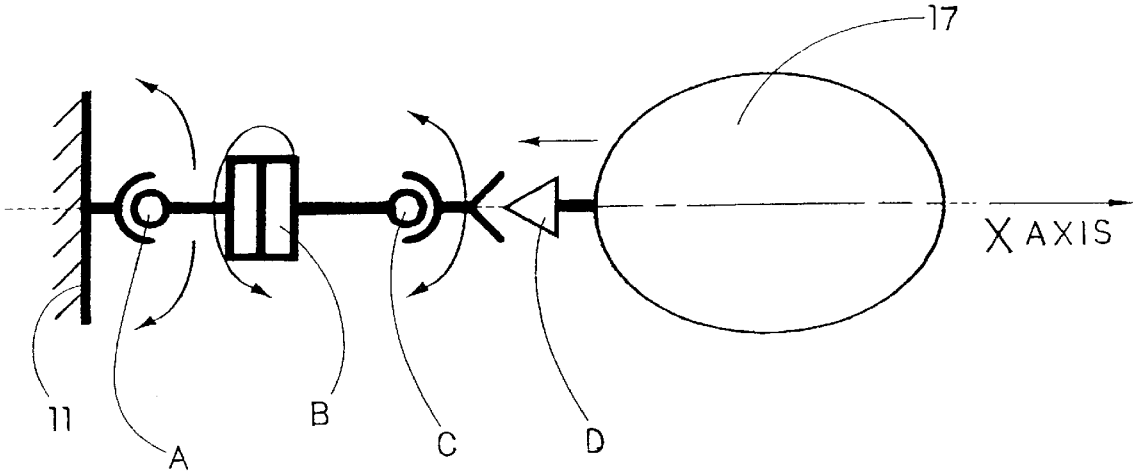
FIG. 3 is a schematic diagram depicting connections of the structural elements of the fan assembly and the movements associated with each connection.

Referring to FIGS. 1–3, a fan assembly of the present invention generally includes a base 11, a wrist assembly 12 coupled to the base 11, a cover 13 housing an electric control core 14, a mechanical core 15, an output assembly 16 and a fan vane element 17.

Operation of the fan assembly of the present invention is based on the three-dimensional convention used with robotic apparatus, as shown by the small schematic reference diagram in FIG. 1. As is well known, in three-dimensional space, the X, Y, and Z axes are arranged relative to one another at 90° angles. Straight reciprocating movement along axis X is hereinafter referred to as the X degree of freedom. Angular movement about axis X is hereinafter referred as the A degree of freedom. Straight reciprocating movement along axis Y is hereinafter referred to as the Y degree of freedom. Angular movement about axis Y is hereinafter referred as the B degree of freedom. Straight reciprocating movement along axis Z is hereinafter referred to as the Z degree of freedom. Angular movement about axis Z is hereinafter referred as the C degree of freedom.

FIGS. 1 and 2 illustrate the structure of the fan assembly and its relationship to the X, Y, A and B axes to which reference has been made above. The X and Y axes are shown in FIG. 2. In FIG. 1, movement of the arm 18 (which includes the cover 13, the electric control core 14, the mechanical core 15, and the output assembly 16) about the Y axis delimits pitching motion of the fan vane element 17. The fan vane element is capable of 180° angular movement about the Y axis. The fan vane element is also capable of 360° angular movement about the X axis.

FIG. 3 is a schematic diagram of the various assemblies of which the fan assembly is comprised, and the respective movements that are afforded by the connections or joints between respective assemblies. At the left side of the figure is the base 11 which constitutes a solid support for the remaining structure of the fan assembly. Connections A and B are associated with a wrist assembly 12 (described in detail below). Connections C and D are associated with the output assembly 16 (described in detail below). Connection A facilitates pivoting motion about the Y axis, while connection B facilitates revolving motion about X axis. Connection C is the hinge where the fan vane element can make back and forth motion. Thus, the fan vane takes the axis line of the hinge as its center to make back and back motion normal to the axis line of the hinge. Connection D facilitates reciprocating motion along the X axis.

Figure 4:
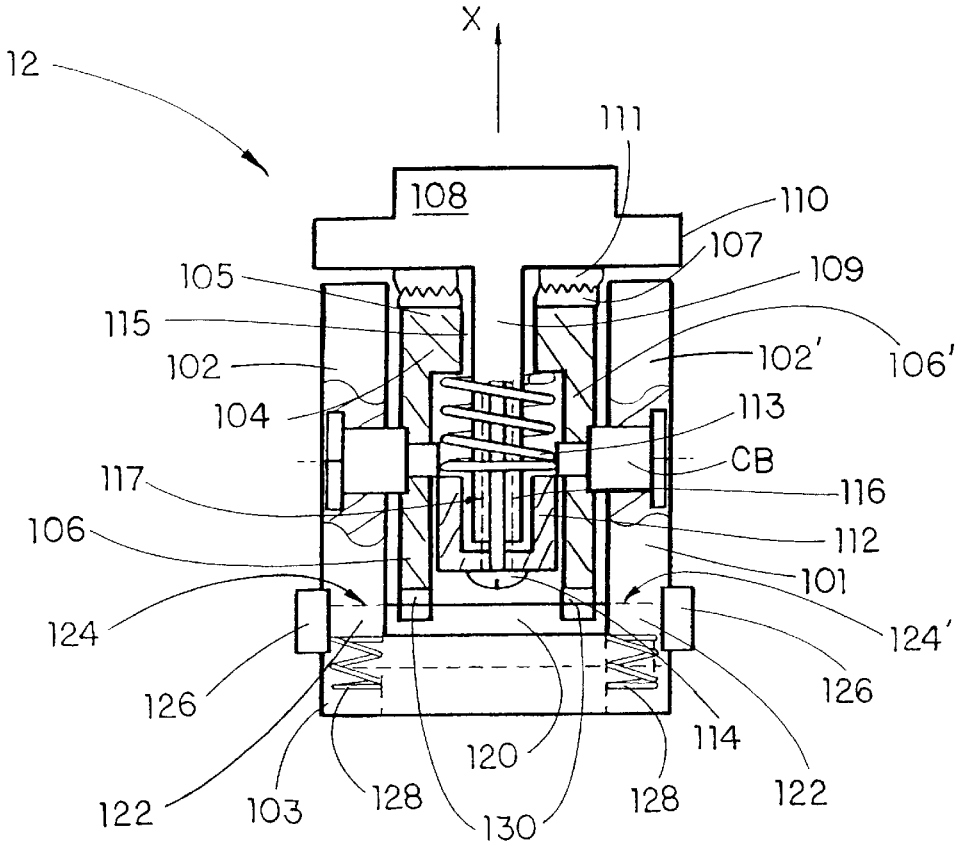
FIG. 4 is a partial cross-sectional view of the wrist assembly of the invention taken from one side of the wrist assembly.
Figure 5:
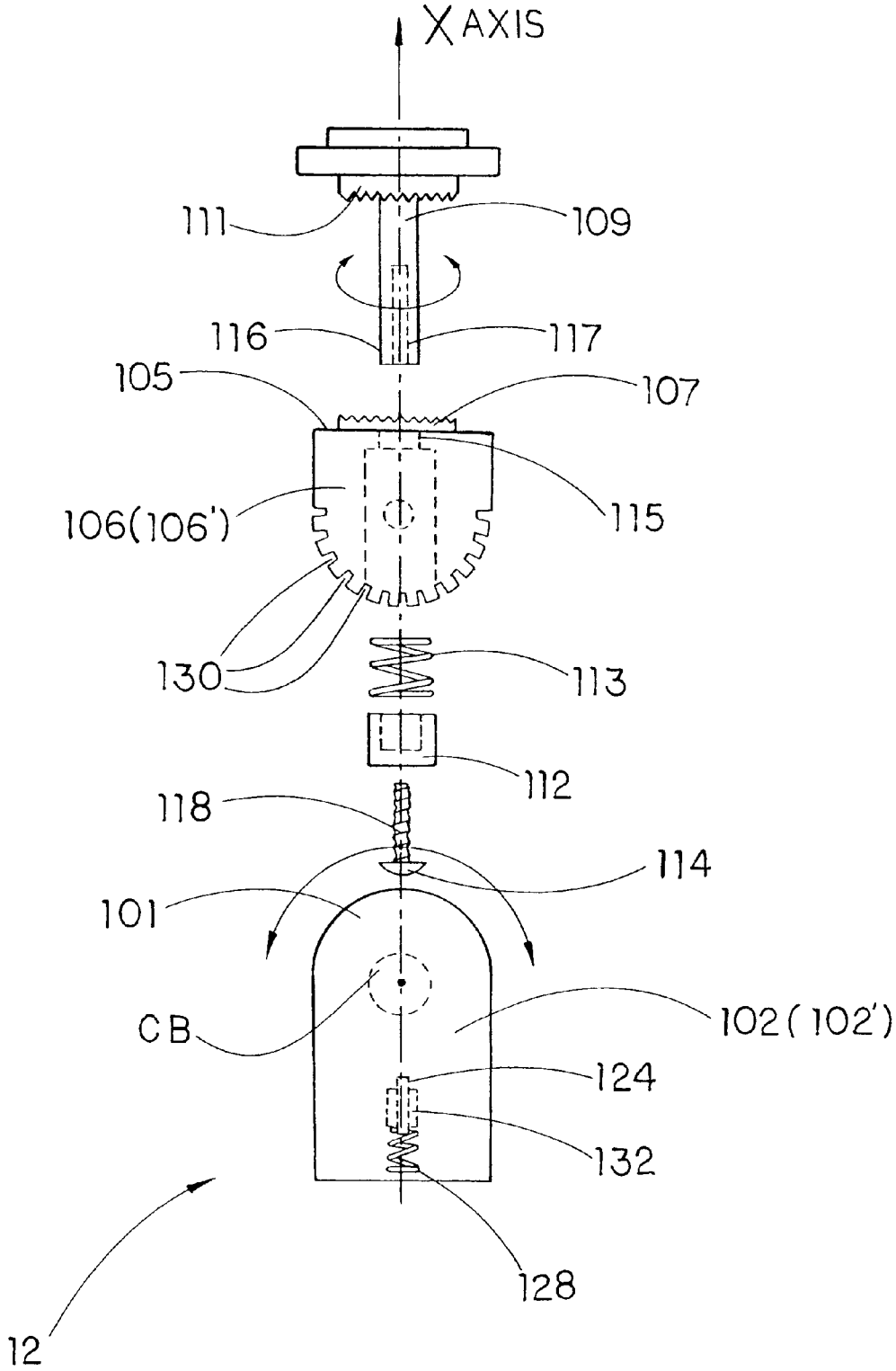
FIG. 5 is an exploded view of the wrist assembly shown in FIG. 4.

The wrist assembly 12 shown in FIGS. 4 and 5 provides a support as well as a connection offering multiple degrees of freedom so that movements including (1) rotations of 180° about the Y axis, and (2) rotations of 360° about the X axis are made possible (see FIGS. 1–3 and discussion above). The outer body or chassis 101 of the wrist assembly 12 is a U-shaped element having opposing, substantially parallel arms 102, 102' extending along the X axis from a base 103. Disposed between the arm 102, 102' is a sleeve element 104, which includes a base portion 105 and a pair of spaced part, opposing arms 106, 106' extending away from the base portion 105. A circular array of gear teeth 107 are arranged on the outer surface of the base portion 105. A cover element 108 includes a shaft portion 110 adapted for insertion into the sleeve element 104 and a cover portion 110 adapted to close the open end of the outer body 101. The underside of the cover portion 110 presents a second array of gear teeth 111 in a circular pattern. Teeth 111 are disposed at a region adjacent the shaft portion 109, and are arranged for mating engagement with the correspondingly configured array of teeth 107. Together the two arrays of gear teeth function as clutch mechanism, as follows. Inside the sleeve element 104 is a cap member 112 and a spring element 113 carried longitudinally about the shaft portion 109 of the cover element 108. The cap member 112 is secured on the free end of the shaft portion 109 by a bolt or other similar threaded fastener 114. The spring element 113 compressed between an upper portion of the cap member 112 and a facing surface of the sleeve element 104. The effect is to pull the cover member 108 tightly into the interior of the outer body 101.

Ordinarily, under the action of spring element 113, the outer body or chassis 101 and the sleeve element 104 are engaged in a predetermined position and/or angle. By applying a small amount of force to lift the shaft portion 109 of the cover element 108 against the bias of the spring element 113, the cover element 108 can be moved longitudinally along the X axis away from the spring element 113 to disengage the two arrays of teeth 107 and 111. Then the cover element 108 can be rotated to adjust its position relative to the sleeve element 104. This adjustment facilitates regulation of the vane's fanning direction.

The wrist assembly 12 also facilitates rotation of the sleeve element 104 180° about the cross bolt 114 (about the B axis). The cross bolt 114 is disposed perpendicular to X axis, and secures the sleeve element 104 to the outer body 101, while presenting a bearing surface to permit rotation of the sleeve element 104 about the B axis between the parallel opposing arms 106, 106'. The base portion 105 of the sleeve element 104 includes a centrally disposed aperture 115 through which the shaft portion 109 of the cover element 108 extends. The free end 116 of the shaft 109 includes an axial bore 117 into which the fastener 118 can be threaded.

Disposed at the lower portion of the outer body or chassis 101 is a sleeve positioning crosspiece 120 which extends laterally across the outer body or chassis 101 and normal to the X axis. The end portions 122 of the positioning crosspiece 120 are disposed for travel in opposing longitudinally arranged slots 124, 124'. The crosspiece 120 terminates in enlarged, opposed head portions 126 captured by the outer wall of the outer body or chassis 101. A pair of compression springs 128 respectively sit beneath opposing sides of the positioning crosspiece 120 for pressing the positioning crosspiece 120 into engagement with one of a series of radially aligned grooves 130 formed on the lower portions of the opposing arms 106, 106' of the sleeve element 104. At least one enlarged head portion 126 (126') of the positioning crosspiece 120 terminates in a switch button 132, as shown in FIG. 5. The button 132 is used for actuation of the wrist structure's second rotation assembly. This is accomplished by pulling the positioning crosspiece 120 downwardly against the biasing force of the compression springs 128 to disengage the positioning crosspiece 120 from one pair of aligned grooves on the opposing arms 106, 106'. With the positioning crosspiece 120 and the opposing arms 106, 106' free of each other, the sleeve element 104 can be rotated about the bolt 114. Preferably this is accomplished by grasping the cover element 108 and forcing it and the sleeve element 104 to rotate to a new position at the same time. Thereafter, the positioning crosspiece 120 can be replaced in locking engagement with the aligned grooves 130 at the lower portion of the opposing arms 106, 106' to secure the sleeve element 104 in the newly chosen position.

The first rotational positioning determines whether the wind from the fan will move horizontally, vertically or in a slanting manner. The second rotational positioning determines whether the wind moves upwardly, downwardly, or sideways. By combining the two positionings plus the up and down range of movement of the fan handle, one can create a wide spectrum of functional flexibility in a variety of situations.

The cover 13 shown in FIG. 1 protects the electric control core 14 of the fan assembly, provides a dust jacket to keep the dust out of contact with the moving parts of the assembly, and facilitates improved aesthetics. The material for the cover 13 can be plastic materials, such as ABS, or thin metal such as aluminum, copper, iron, etc.

When choosing the cover 13, the factors to be considered are the technology, the outlook and the cost. For convenience in manufacturing and in assembly, it is better to use an integral composition structure to simplify the technology and to beautify the environment. Assembly of the cover 13 to the assembly preferably requires a screw fastener. The cover 13 may be provided in various colors, and if using engineering plastics, the original color of the plastic can be used. If using metal, it should be painted with electrophoresis, spray paint, spray plastic, roast paint or electroplate.

Figure 6:
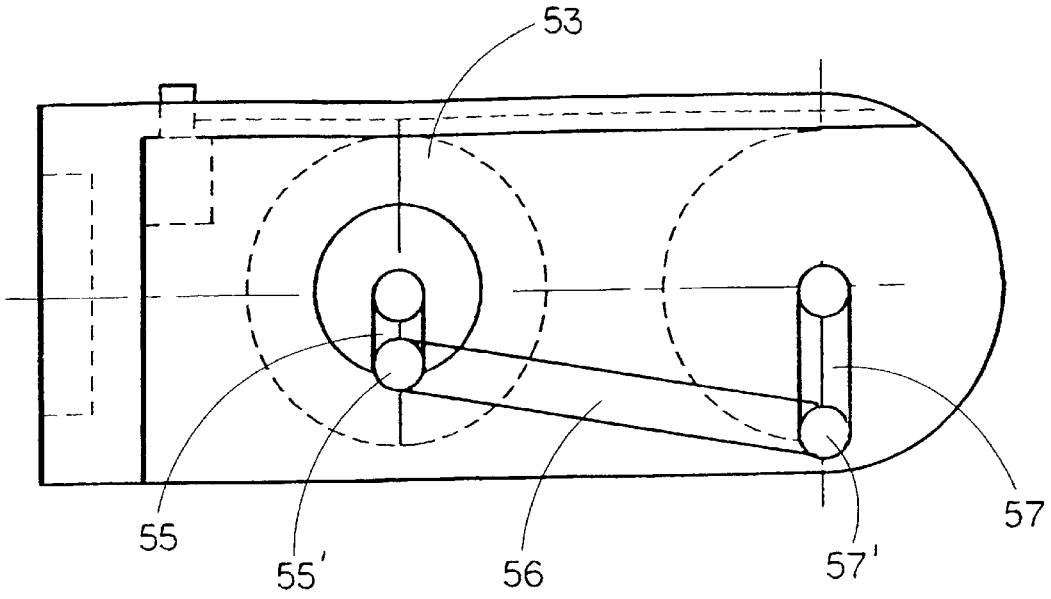
FIG. 6 is a top view of a mechanical control mechanism for a first embodiment of the present invention.
Figure 7:
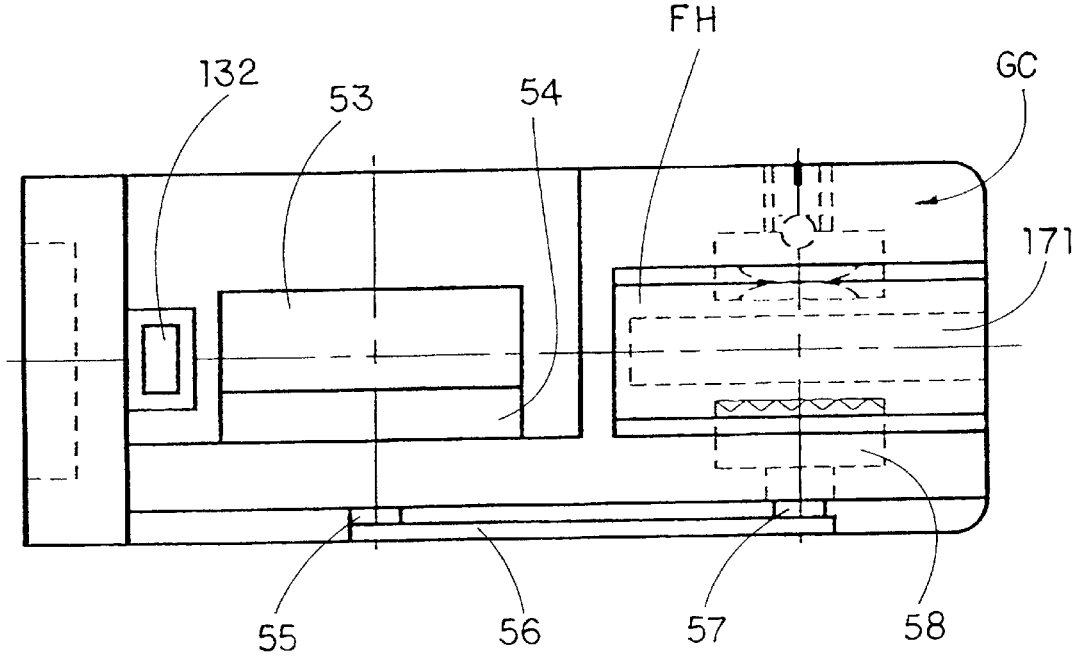
FIG. 7 is a side view of the mechanical control mechanism shown in FIG. 6.

FIGS. 6 and 7 depict a first embodiment of the motion generating device of the present invention. An alternating circuit induction motor 53 is coupled to a first "driving" rocker 55 through a speed reducer 54 for slowing down the speed of the motor 53 so that the rocker 55 can be driven in slow circulating motion. The first rocker 55 includes a shaft 55' connected to a pitman 56, which in turn is connected to a second rocker 57. The second rocker 57 has a length greater than the radius between the crank rod of the first driving rocker 55 and its center. The two lengths are comparatively set to a ratio such that when the driving rocker 55 makes a revolving movement, the driven rocker 57 will make a fan shaped movement. The driven rocker 57 is connected to an output axle member 57' and drives, via a gear clutch 58, the fan handle 171 to make fanning movements. When the fan handle 171 or the fan vane element 17 interrupted in its movement, the clutch 58 automatically skids so as to protect the core from being damaged, thereby acting as a safety feature.

Figure 12:
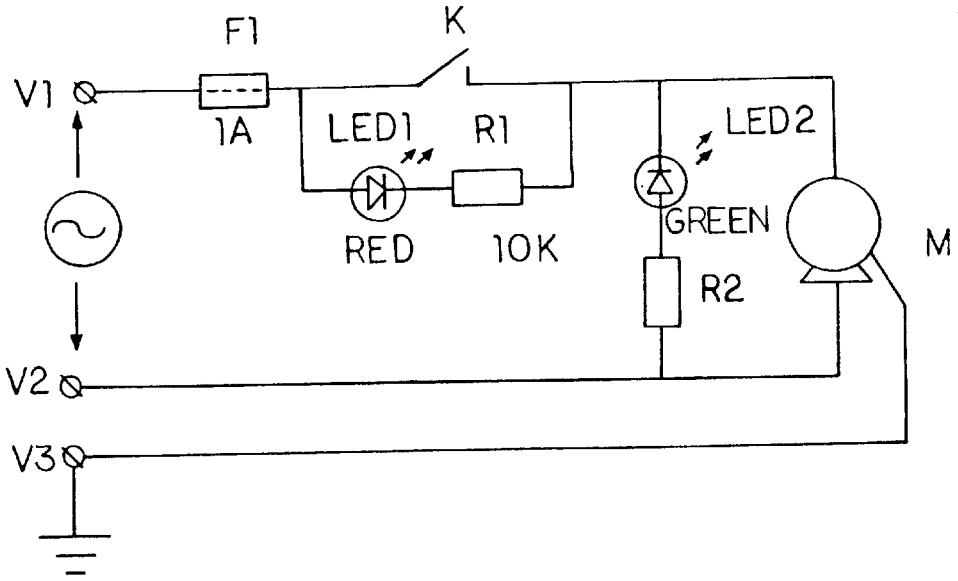
FIG. 12 is a schematic diagram for an electric control mechanism used with the first embodiment of mechanical control mechanism shown in FIGS. 7 and 8.

The electric circuit for the embodiment shown in FIGS. 6 and 7 is shown in FIG. 12 that includes a fuse F1, a switch K, an off-signal indicator LED1, a current limiting resistor R1, an on-signal indicator LED2, a current limiting resistor R2, an alternating circuit indicator motor M, and three connectors V1, V2, and V3.

The connectors V1 and V2 connect to a power source (not shown). Because of the matching effect of the width of the plugs, the hot wire connects to V1, the neutral wire connects to V2, and the protecting ground wire connects to V3. Preferably, the hot wire connects to one side of the fuse F1. The fuse F1 breaks when the electric current becomes excessive, and therefore the fuse F1 protects the motor. The other side of the fuse F1 connects to the switch K, which when turned on or off, will correspondingly start or stop the motor so as to start or stop the fan apparatus. The switch K constitutes the main control mechanism.

The indicator LED1 is a red emitting light diode which is connected in series with the resistor R1 and in parallel with the switch K. The value of the resistor R1 is preferably chosen to make the current reach 10 milliamperes. The indicator LED1 is used to show whether the principal current is on or off. When the current is cut off, the indicator LED1 will emit red light, indicating an "off" state of the circuit. When the switch K is closed, the branch circuit will be short circuited and the red light will turn off.

The indicator LED2 is a green emitting light diode that is connected in series with the resistor R2 and the value of this resistor is also chosen to limit the current passing through it to 10 milliamperes. LED2 and R2 are connected to the motor in parallel. When the switch K is closed, LED2 will emit green light to show that the power is on, and the whole machine is in a working state. When the switch is open, the indicator LED2 is not functional. When the machine is on, the green light is on, when the machine is off, the red light is on. When no electricity is present, no light will be on. The characteristic of this circuit is in its small volume, long life and simplicity. If a metal cover is to be used for this embodiment, it will have to be grounded for safety.

Figure 8:
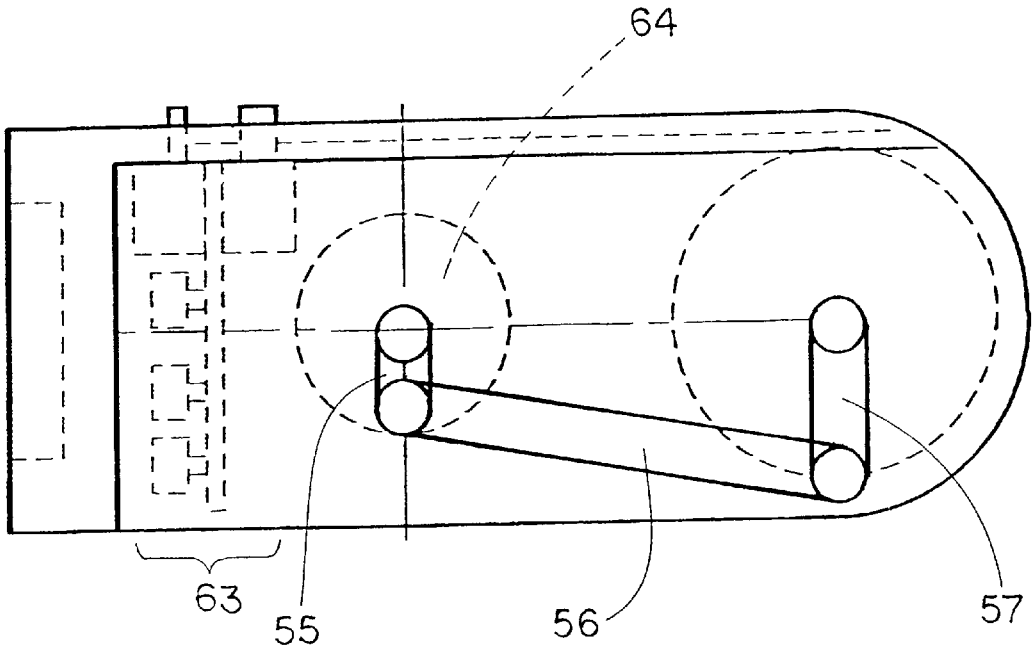
FIG. 8 is a top view of a mechanical control mechanism for a second embodiment of the present invention.
Figure 9:
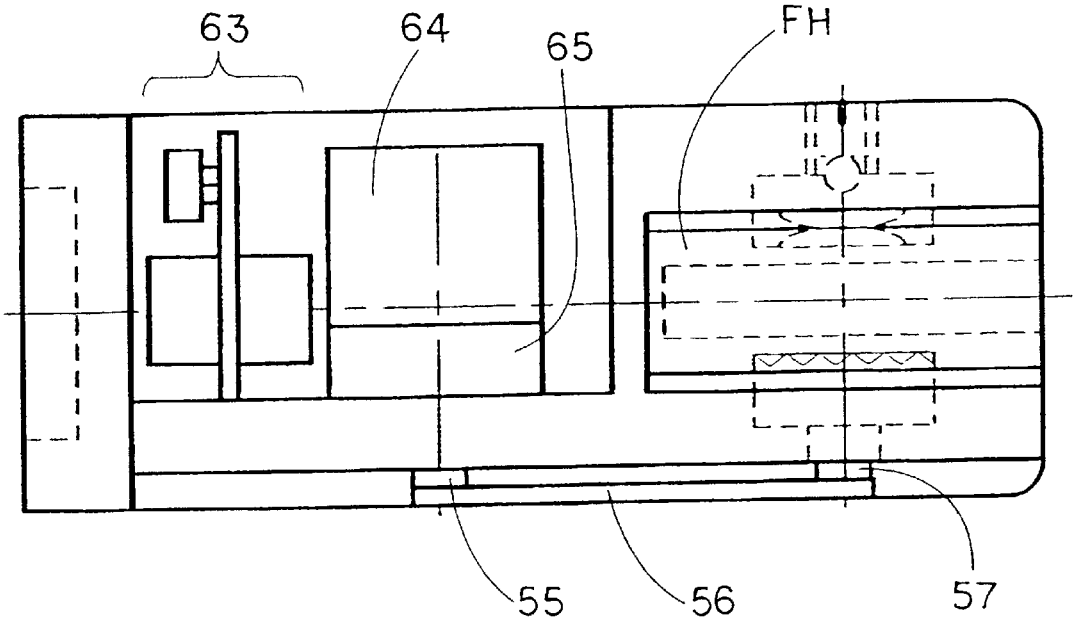
FIG. 9 is a side view of the mechanical control mechanism for shown in FIG. 8.

FIGS. 8 and 9 depict a second embodiment of the motion generating device of the fan assembly according to the present invention. Here, the motor 64 drives rocker 55 through a speed reducing worm gear or gear group 65 to produce a revolving movement. The remaining mechanical components are the same as those described in the structure shown in FIGS. 6 and 7. A standard silicon-controlled voltage regulating speed change circuit is used in this embodiment (see the description below). Changing the speed of revolution can be accomplished by turning the potentiometer W1 thereby changing the conduction angle to regulate the voltage and to change the revolving speeds of the alternating and DC current motors. The effect is to accomplish a stepless speed change from slow to fast, or from fast to slow, to meet the user's needs.

Figure 13:
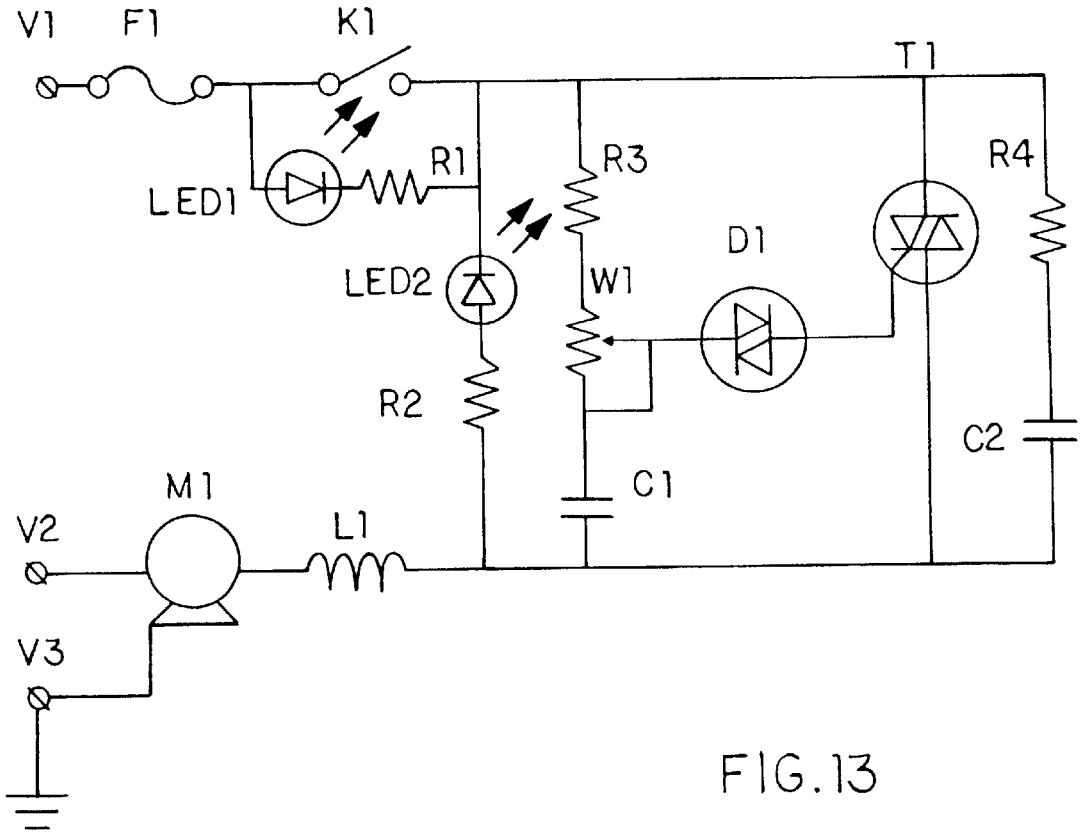
FIG. 13 is a schematic diagram for an electric control mechanism used with the second embodiment of mechanical control mechanism shown in FIGS. 9 and 10.

The electric circuit for the embodiment shown in FIGS. 8 and 9 is shown in FIG. 13, and includes a fuse F1, a main switch K1, an off-signal indicator LED1, a current limiting resistor R1, an on-signal indicator LED2, a current limiting resistor R2, a current dividing resistor R3, a speed regulating potentiometer W1, a charging trigger capacitor C1, a slow rising terminal voltage resistor R4, a slow rising terminal voltage capacitor C2, two-terminal two-way trigger diode D1, a three-terminal alternating current silicon controlled rectifier switch T1, an alternating and direct current motor M1, three connectors V1, V2, V3, and a motor magnetic field coil L1.

The charging trigger capacitor C1, along with the components R2, W1 and C1, determine the charging time. The trigger diode D1 is triggered to an "on" state when the voltage at C1 reaches conduction voltage. The rectifier switch T1 is triggered to an "on" state when the trigger diode is off. Since this is a two-way circuit transmitter, it has high efficiency in the presence of an alternating current. When diode T1 triggers the conduction, the principal circuit forms a return circuit and the motor M1 turns on. Adjusting W1 may change the charging constant of capacitor C1 so as to change the condition angle. Changing the conduction angle enables regulation of the voltage to control the speed of the motor.

The circuit also includes a resistance-capacitance circuit composed of R4 and C2 which is connected in parallel with the rectifier T1. The purpose of this circuit is to delay the rising of the voltage after it passes the zero potential cutoff, and thereby control the trigger to raise the stability. LED1 and R1 combine to show the cut-off state, and LED2 and R2 combine to show the "on" state.

Figure 10:
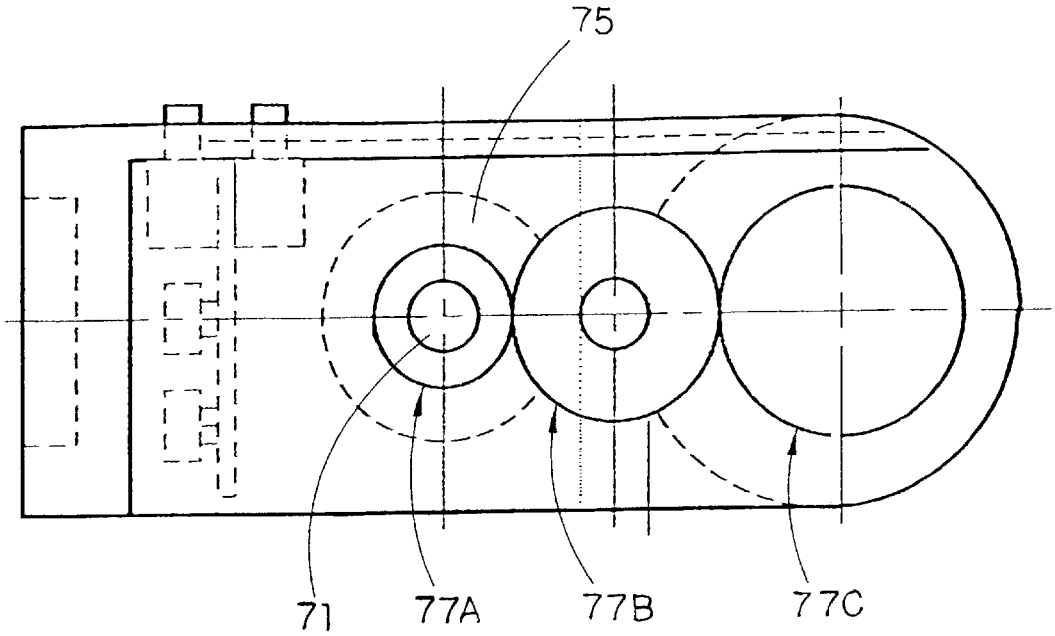
FIG. 10 is a top view of the mechanical control mechanism for a third embodiment of the present invention.
Figure 11:
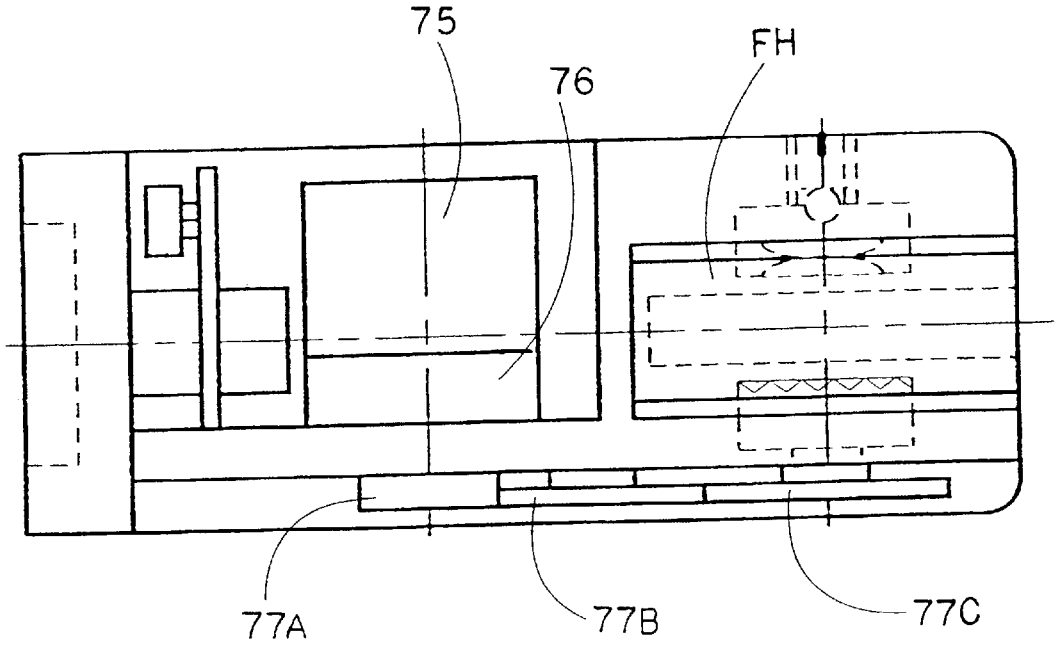
FIG. 11 is a side view of the mechanical control mechanism for shown in FIG. 10.
Figure 14:
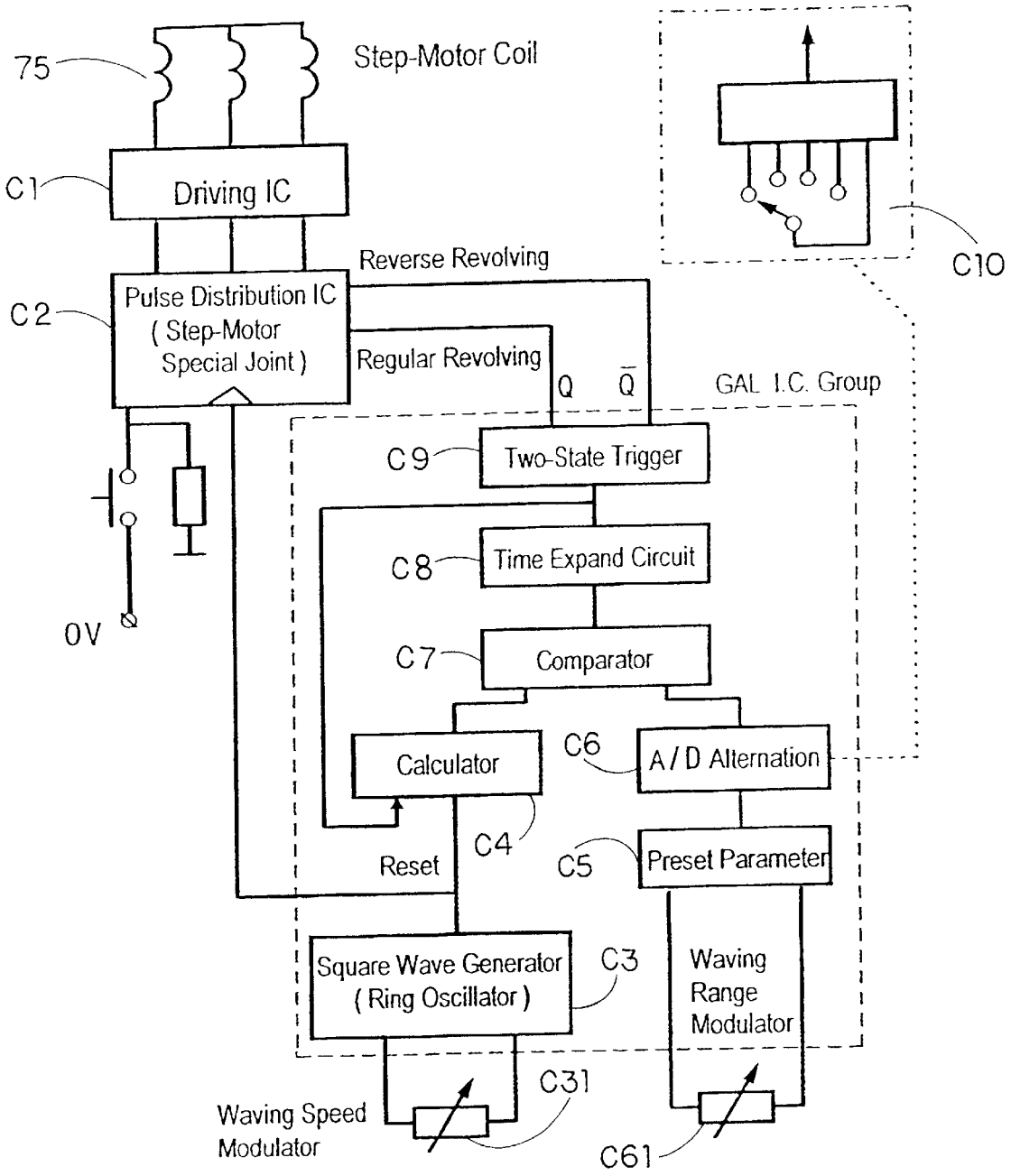
FIG. 14 is a logic block diagram for an electronic control mechanism used with the third embodiment of mechanical control mechanism shown in FIGS. 11 and 12.

FIGS. 10 and 11 disclose a third embodiment of the motion generating apparatus of the present invention. In this arrangement of elements, the step motor 75 drives the output axle 71 via a harmonic speed reducer 76. This combination of elements constitutes a compact and simple structure. The key component of this embodiment is the vane waving speed and motion control circuit. As shown in FIG. 14, the electronic circuit used with this embodiment can respectively adjust the waving speed and the waving range of the fan vane element. This embodiment also permits use of D—D control and direct driving structure.

Control of this embodiment of motion generating apparatus is accomplished by an electronic circuit, the schematic for which is shown in FIG. 14. The circuit is composed of four principal parts: a step-motor control component for regulating the waving speed of the fan vane element 17, a waving direction control component for regulating the waving range, and a waving speed control component for regulating the back and forth waving speed.

The step motor 75 is used to perform various controlling functions. The step motor 75 is started by a driving integrated circuit C1 and a pulse distribution integrated circuit C2. The driving integrated C1 is power amplifying integrated circuit cubes and the pulse distribution integrated circuit C2 is a step motor pulse distributor. When the pulse signal source generated by a square wave generator C3 are transmitted to the pulse distribution integrated circuit C2, a three phase single six beat sequence pulse is produced at the output terminal of pulse distribution integrated circuit C2 which, after being amplified, is used to drive the step motor 75 to drive the fan vane element 17 of the fan. The speed control of the s tep motor 75 is achieved by changing the frequency of the square wave generator C3. The square wave generator C3 is composed of a ring oscillator. Turning a potentiometer C31 will change the vibration frequency so as to achieve the stepless control of the step motor 75.

Control of the waving range of the fan vane element 17 is achieved through the use of a calculator C4 and a preset data functional block C5 and a function block A/D C6. Hand turning of potentiometer C61 may set a parameter, and by changing the parameter, the preset data can be outputted to the function block A/D C6. When a comparator C7 reads the data from calculator C4 and the function block A/D C6, it compares them, and when the data are the same it sends out a pulse. This pulse is time-expanded through a time-expand circuit C8, and then passed into a two-state trigger C9 to produce pulse from the triggers output terminal to control the back and forth revolution of the pulse distribution integrated circuit C2. The time-expanded pulse also is sent back to the calculator C4 to become a clear signal. The calculator C4 will clear zero and start calculating from the very beginning every time it completes a calculation circle.

The automatic reversal of the waving direction is achieved by the two-state trigger device C9. Because of the special properties of the two-state circuit, every input of a pulse will cause the two state trigger turn once and remain there. The positive and negative terminals of the trigger device respectively control the positive and negative turning terminals of the pulse distributor of the step-by-step motor so as to make the motor revolve back and forth, thereby causing the fan vane element 17 to wave back and forth.

The waving range can be preset through the use of a digital switch C10. The preset data will be transmitted to the comparator C7 by turning the preset switch C10, via function block A/D C6, to achieve comparison control. These functions can be developed and achieved in a GAL programmable processor provided in this circuit in order to reduce the volume, lower the cost and raise reliability. Based on the speed and range regulation, more sophisticated software can be incorporated into the processor to imitate natural wind, intermittent wind, etc. The circuit can be controlled from a distance by the use of infrared, microwave and other remote actuators.

Figure 15:
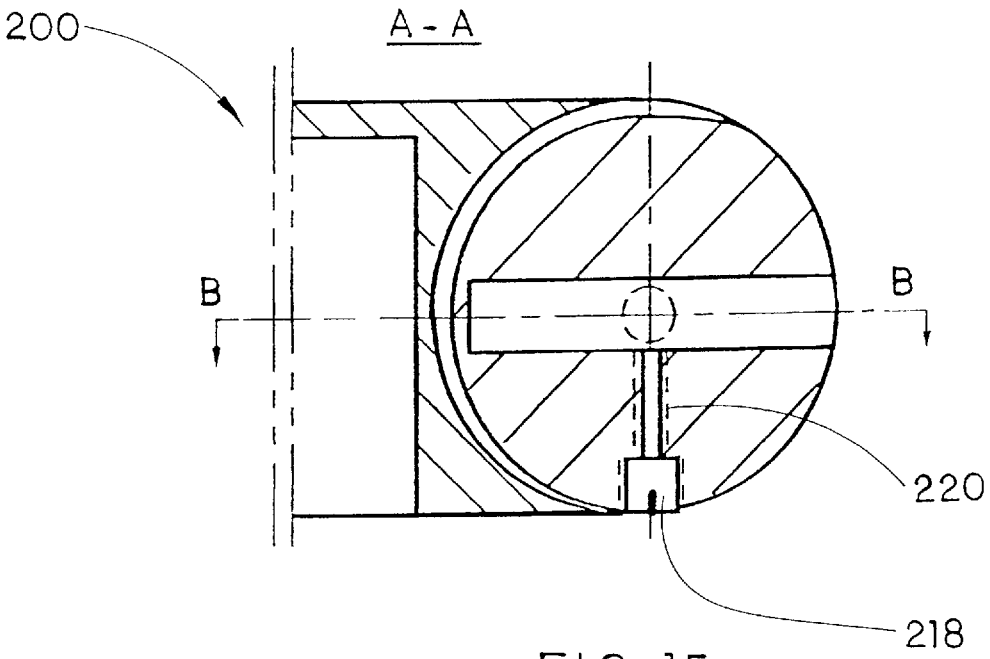
FIG. 15 is a sectional top view of the output transmission assembly of the present invention.
Figure 16:
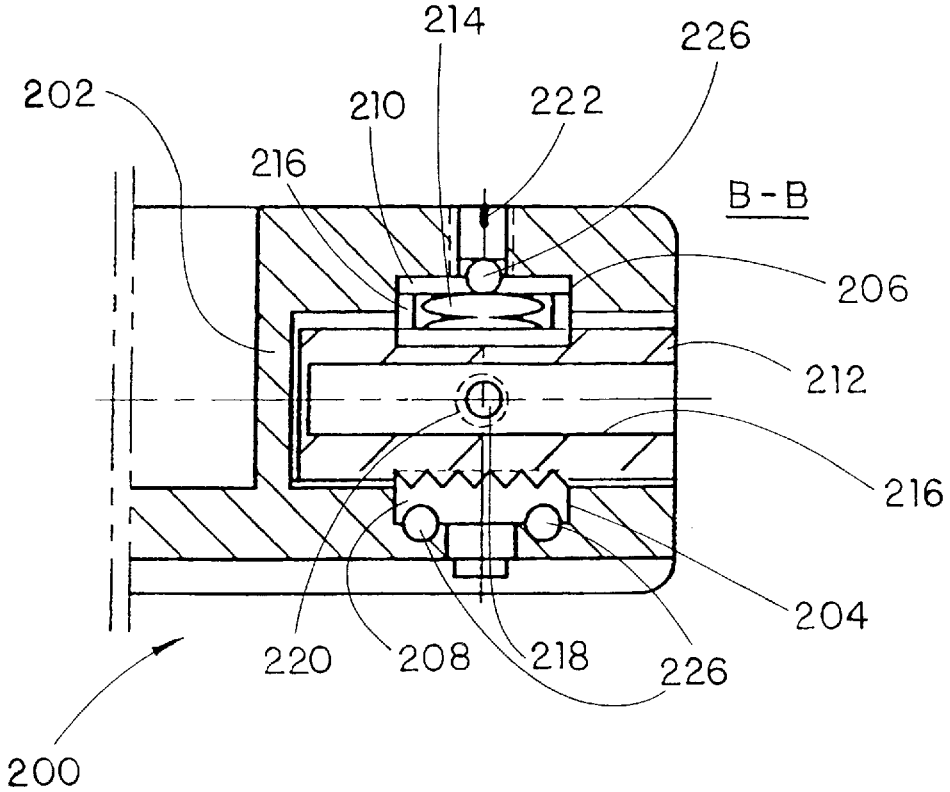
FIG. 16 is a sectional side view of the output transmission assembly taken along section lines B—B in FIG. 15.
Figure 17A:
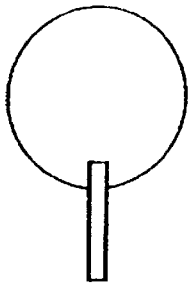
FIGS. 17(*a*)–17(*f*) illustrate various configurations of fan vane elements that can be used with the movement controlling mechanism of the present invention.
Figure 17B:
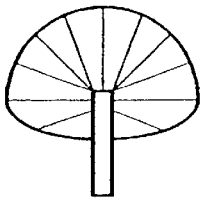
Figure 17C:
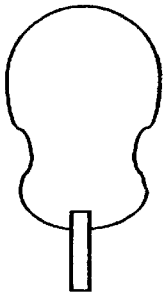
Figure 17D:
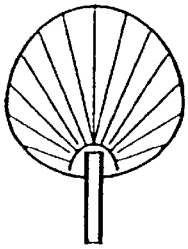
Figure 17E:
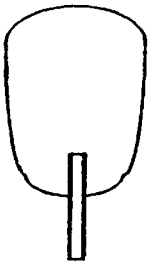
Figure 17F:
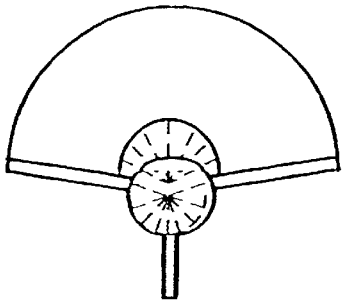
Figure 18A:
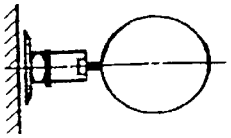
FIGS. 18(*a*) and 18(*b*), 19(*a*) and 19(*b*), 20(*a*) and 20(*b*), 21(*a*) and 21(*b*), and 22(*a*) and 22(*b*) show various embodiments of the fan assembly of the present invention.
Figure 18B:
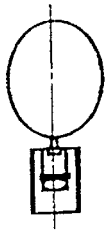
Figure 19A:
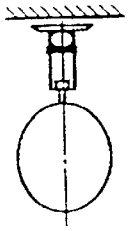
Figure 19B:
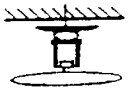
Figure 20A:
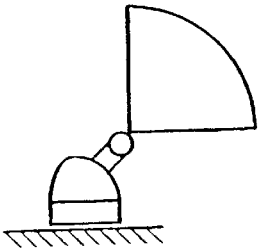
Figure 20B:
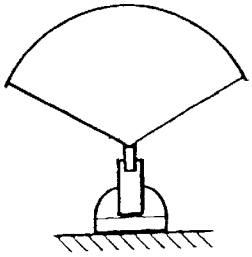
Figure 21A:
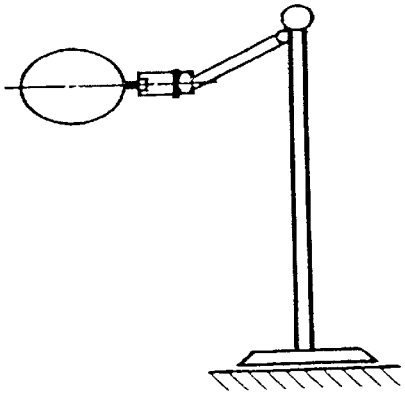
Figure 21B:
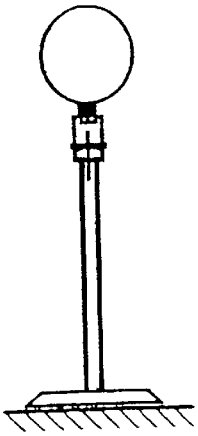
Figure 22A:
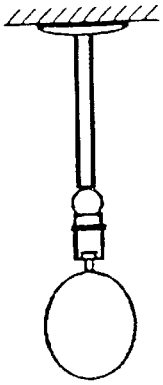
Figure 22B:
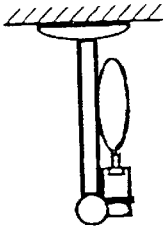

FIGS. 15 and 16 depict the output assembly 16 which is a motion output assembly. A forward end of a core support 202 has two cylindrical recesses 204, 206, with each recess having a longitudinal axis arranged normal to the longitudinal axis of the core support 202 (i.e., parallel to the X axis). A gear transmission half axle 208 is mounted in the cylindrical recess 204, while a half axle transmission supporting cylinder 210 is mounted and secured in the cylindrical recess 206. The gear transmission half axle 208 and half axle transmission supporting cylinder 210 support a transmission junction core 212 which is a revolving fan handle chassis having its longitudinal axis coincident with the longitudinal axis of the core support 202. The gear transmission half axle 208 has a circular array of teeth on the surface thereof that engages the transmission junction core 212. A similar array of gear teeth is borne by the surface of the half axle transmission supporting cylinder 210. Under pressure from a plate shaped spring element 214, a cage 216 that supports the gear transmission half axle 208 pushes the transmission junction core 212 toward the gear transmission half axle 208. The gear teeth on the gear transmission half axle 208 and the revolving fan handle chassis 212, under such pressure, thus function as a gear clutch.

When the power generated by the motor drives the crank attached to the gear transmission half axle 208 to generate back and forth movement, the crank transmits the motion and force to the gear transmission half axle 208 and then to the transmission connection core 212. The transmission connection core 212 has a longitudinal bore 216 into which the fan handle is inserted and secured via a locking screw 218 extending normal to the longitudinal bore in a passage 220.

When the screw 218 is loosened, different fan vane elements can be inserted to meet different needs. When the fan vane element is interrupted by an outside force, the teeth of the gear clutch will lock and the transmission connection core 212 will be forced toward the gear transmission half axle 208. When the outside force is large enough, the engaged gear teeth will slip so as to protect the transmission connection core 212 from being damaged. The range of such protective movement can be regulated by adjusting the regulating screw 222 which is biased outwardly, away from the transmission connection core 212 by the spring element 214 held within the cage 216 and a ball element 226 which is disposed between the screw 222 and the spring element 214. Pushing fan handle may preset the range of the vane movement and starting and ending point of the vane action. When idle, the vane can be positioned in such a way as to make it artistic and harmonious with the room.

In summary, therefore, the output transmission assembly 200 has four functions: (1) to provide a means for adjusting the up and down range of the fan vane element; (2) to provide a means for protecting against tension that is too large; (3) to provide an quick and easy way for changing the fan handle; and (4) to provide a means for positioning the fan vane element when it is not in use.

FIGS. 17(*a*) through 17(*f*) disclose various configurations of fan vane elements that can be used with the motion generating apparatus of the present invention. In addition to the various shapes, it is desirable to use specific materials as well. For example, the use of plastic frames has been found to be advantageous. The plastic is preferably an engineering plastic which is easily moldable. The vane is preferably covered in, or comprised of, a material such as paper, silk or plastic. In addition, natural materials for the vane can be used, such as feathers, bone, palm leaves, straw, or cattail leaves. The invention also contemplates the use of folding fans, including a rod connected thereto for insertion into the shaft in the output conjunction.

Those skilled in the art will appreciate that various adoptions and modifications of the just-described preferred embodiments can be configured without departing from the scope and spirit of the invention. Therefore, it is to be understood that, within the scope of the appended claims, the invention may be practiced other than as specifically described herein.

What I claim is:

1. An electric waving fan, comprising a fan vane element having a longitudinal axis;

a base providing a base axis and forming a solid support for said fan vane element;

a wrist assembly coupled between said base and said fan vane element for enabling said fan vane element to have a 180 degree pivoting motion perpendicular to said base axis and a 360 degree revolving motion about said base axis, so as to adjust a fanning direction of said fan vane element with respect to said base axis, wherein said wrist assembly comprises:

an outer body integrally and coaxially affixed on said base, a sleeve element pivotally connected with said outer body, a cover element supported ahead of said outer body, means for rotatably attaching said cover element to said sleeve element so as to enable said cover element to selectively rotate 360 degree about a longitudinal axis of said sleeve element, and means for engaging said sleeve element with said outer body so as to selectively adjust an angular position of said sleeve element with respect to said outer body; and a motion generating device having one end affixedly and coaxially connected to said cover element of said wrist assembly for driving said fan vane element to delimit a back and forth pitching motion normal to said longitudinal axis of said fan vane element, wherein said motion generating device comprises:

a motor for generating power, an output assembly for holding said fan vane element, and a transmission apparatus for converting said power to motion that drives said fan vane element via said output assembly to move back and forth.

2. An electric waving fan, as recited in claim 1, wherein said outer body of said wrist assembly is a U-shaped element having a pair of opposing, substantially parallel arms extending along said base axis from said base, said sleeve element which is disposed between said two arms including a base portion and a pair of spaced apart, opposing arms extending away from said base portion, wherein said cover element including a shaft portion inserted into said sleeve element and a cover portion arranged to close an open end of said outer body.

3. An electric waving fan, as recited in claim 2, wherein said attaching means includes a first array of gear teeth provided on an outer surface of said base portion and arranged in a circular manner, a second array of gear teeth provided on an underside of said cover portion and arranged in a circular manner, wherein said second array of gear teeth are disposed at a region adjacent said shaft portion and are arranged for mating engagement with said correspondingly configured first array of gear teeth, moreover inside said sleeve element is a cap member and a spring element carried longitudinally about said shaft portion of said cover element, said cap member being secured on a free end of said shaft portion by a threaded fastener, said spring element being compressed between an upper portion of said cap member and a facing surface of said sleeve element so as to pull said cover member tightly into an interior of said outer body, wherein by means of said spring element, said outer body and said sleeve element are engaged in a predetermined position and angle, and that by applying a force to lift said shaft portion of said cover element against said bias of said spring element, said cover element is capable of moving longitudinally along said base axis away from said spring element to disengage said two first and second arrays of gear teeth so as to enable said cover element being rotated about said longitudinal axis of said sleeve element for adjusting said fanning direction of said fan vane element.

4. An electric waving fan, as recited in claim 3, wherein said threaded fastener is disposed perpendicular to said base axis and secures said sleeve element to said outer body, wherein while presenting a bearing surface to permit rotation of said sleeve element between said parallel opposing arms, said base portion of said sleeve element includes a centrally disposed aperture through which said shaft portion of said cover element extends, said free end of said shaft including an axial bore for said threaded fastener to screw therein.

5. An electric waving fan, as recited in claim 3, wherein said transmission apparatus comprises a driving rocker coupled to said induction motor through a speed reducer for slowing down a speed of said motor so that said driving rocker can be driven in slow circulating motion, wherein said driving rocker includes a shaft connected to a pitman, which in turn is connected to a driven rocker, said driving rocker having a first length and said driven rocker having a second length greater than a radius between a crank rod of said driving rocker and a center thereof, where said first and second lengths are comparatively set to a ratio such that when said driving rocker makes a revolving movement, said driven rocker makes a fan shaped movement, moreover said driven rocker is connected to an output axle member and drives, via a gear clutch, said fan vane element to make fanning movements.

6. An electric waving fan, as recited in claim 3, wherein said output assembly comprises a core support having a forward end which has two cylindrical recesses, each of said recesses having a longitudinal axis arranged normal to a longitudinal axis of said core support that is parallel to said base axis, a gear transmission half axle mounted in one of said cylindrical recesses while a half axle transmission supporting cylinder is mounted and secured in said another cylindrical recess, said gear transmission half axle and half axle transmission supporting cylinder supporting a transmission junction core which is a revolving fan handle chassis having a longitudinal axis coincident with said longitudinal axis of said core support, said gear transmission half axle having a first array of teeth provided thereon in circular manner that engages said transmission junction core, a second array of gear teeth is borne by a surface of said half axle transmission supporting cylinder, wherein under pressure from a plate shaped spring element, a cage that supports said gear transmission half axle pushes said transmission junction core toward said gear transmission half axle, and said gear teeth on said gear transmission half axle and said revolving fan handle chassis function as a gear clutch.

7. An electric waving fan, as recited in claim 3, wherein said engaging means includes a positioning crosspiece which is disposed at a lower portion of said outer body and extended laterally across said outer body and normal to said base axis, wherein two end portions of said positioning crosspiece are respectively disposed for travel in two opposing longitudinally arranged slots provided at said two parallel arms of said outer body, at least a compression spring being sit beneath said positioning crosspiece for pressing said positioning crosspiece into engagement with one of a series of radially aligned grooves formed on lower portions of said two opposing arms of said sleeve element, wherein by pulling said positioning crosspiece downwardly against a biasing force of said compression spring to disengage said positioning crosspiece from one pair of said aligned grooves on said opposing arms, said sleeve element is thus able to be pivotally turn with respect to said outer body so as to adjust a fanning position of said fan vane element, afterwards said positioning crosspiece is replaced in locking engagement with a pair of said aligned grooves at said lower portions of said opposing arms so as to secure said sleeve element in said newly adjusted fanning position.

8. An electric waving fan, as recited in claim 7, wherein said output assembly comprises a core support having a forward end which has two cylindrical recesses, each of said recesses having a longitudinal axis arranged normal to a longitudinal axis of said core support that is parallel to said base axis, a gear transmission half axle mounted in one of said cylindrical recesses while a half axle transmission supporting cylinder is mounted and secured in said another cylindrical recess, said gear transmission half axle and half axle transmission supporting cylinder supporting a transmission junction core which is a revolving fan handle chassis having a longitudinal axis coincident with said longitudinal axis of said core support, said gear transmission half axle having a first array of teeth provided thereon in circular manner that engages said transmission junction core, a second array of gear teeth is borne by a surface of said half axle transmission supporting cylinder, wherein under pressure from a plate shaped spring element, a cage that supports said gear transmission half axle pushes said transmission junction core toward said gear transmission half axle, and said gear teeth on said gear transmission half axle and said revolving fan handle chassis function as a gear clutch.

9. An electric waving fan, as recited in claim 7, wherein said transmission apparatus comprises a driving rocker coupled to said induction motor through a speed reducer for slowing down a speed of said motor so that said driving rocker can be driven in slow circulating motion, wherein said driving rocker includes a shaft connected to a pitman, which in turn is connected to a driven rocker, said driving rocker having a first length and said driven rocker having a second length greater than a radius between a crank rod of said driving rocker and a center thereof, where said first and second lengths are comparatively set to a ratio such that when said driving rocker makes a revolving movement, said driven rocker makes a fan shaped movement, moreover said driven rocker is connected to an output axle member and drives, via a gear clutch, said fan vane element to make fanning movements.

10. An electric waving fan, as recited in claim 9, further comprising an electric circuit which includes a fuse F1, a switch K, an off-signal indicator LED1, a current limiting resistor R1, an on-signal indicator LED2, a current limiting resistor R2, an alternating circuit indicator motor M, and three connectors V1, V2, and V3, wherein said connectors V1 and V2 connect to a power source, a hot wire connecting to said connector V1, a neutral wire connecting to said connector V2, and a protecting ground wire connecting to said connector V3, wherein said hot wire connects to one side of said fuse F1 which breaks when an electric current of said electric circuit becomes excessive, and therefore said fuse F1 protects said motor, and another side of said fuse F1 connects to said switch K, which when turned on or off, correspondingly stars or stops said motor so as to start or stop said electric waving fan, moreover said indicator LED1 is a red emitting light diode which is connected in series with said resistor R1 and in parallel with said switch K for illustrating whether said electric current is on or off, and that a value of said resistor R1 being chosen to make said electric current reach 10 milliamperes. Furthermore said indicator LED2 is a green emitting light diode that is connected in series with said resistor R2 and a value of said resistor R2 is also chosen to limit said electric current passing therethrough to 10 milliamperes, wherein said indicator LED2 and R2 are connected to said motor in parallel, so that when said switch K is closed, said indicator LED2 emits green light to show power on condition, and that when said switch is open, said indicator LED2 is not functional.

11. An electric waving fan, as recited in claim 9, wherein said output assembly comprises a core support having a forward end which has two cylindrical recesses, each of said recesses having a longitudinal axis arranged normal to a longitudinal axis of said core support that is parallel to said base axis, a gear transmission half axle mounted in one of said cylindrical recesses while a half axle transmission supporting cylinder is mounted and secured in said another cylindrical recess, said gear transmission half axle and half axle transmission supporting cylinder supporting a transmission junction core which is a revolving fan handle chassis having a longitudinal axis coincident with said longitudinal axis of said core support, said gear transmission half axle having a first array of teeth provided thereon in circular manner that engages said transmission junction core, a second array of gear teeth is borne by a surface of said half axle transmission supporting cylinder, wherein under pressure from a plate shaped spring element, a cage that supports said gear transmission half axle pushes said transmission junction core toward said gear transmission half axle, and said gear teeth on said gear transmission half axle and said revolving fan handle chassis function as a gear clutch.

12. An electric waving fan, as recited in claim 9, further comprising a standard silicon-controlled voltage regulating speed change circuit which includes a fuse F1, a main switch K1, an off-signal indicator LED1, a current limiting resistor R1, an on-signal indicator LED2, a current limiting resistor R2, a current dividing resistor R3, a speed regulating potentiometer W1, a charging trigger capacitor C1, two-terminal two-way trigger diode D1, a three-terminal alternating current silicon controlled rectifier switch T1, an alternating and direct current motor M1, three connectors V1, V2, V3, and a motor magnetic field coil L1, wherein said charging trigger capacitor C1, along with said components R2, said speed regulating potentiometer W1 and said charging trigger capacitor C1, determine a charging time thereof, said trigger diode D1 being triggered to an "on" state when a voltage at said charging trigger capacitor C1 reaches a conduction voltage, said three-terminal alternating current silicon controlled rectifier switch T1 being triggered to an "on" state when said trigger diode is off, wherein when said three-terminal alternating current silicon controlled rectifier switch T1 triggers said conduction, said standard silicon-controlled voltage regulating speed change forms a return circuit and said motor M1 turns on, moreover adjusting said speed regulating potentiometer W1 changes said charging constant of said charging trigger capacitor C1 so as to change a condition angle thereof so as to control a speed of said motor.

13. An electric waving fan, as recited in claim 12, wherein said standard silicon-controlled voltage regulating speed change circuit further includes a resistance-capacitance circuit composed of a slow rising terminal voltage resistor R4 and a slow rising terminal voltage capacitor C2 which is connected in parallel with said three-terminal alternating current silicon controlled rectifier switch T1.

14. An electric waving fan, as recited in claim 9, wherein said motor is a step motor and said speed reducer is a harmonic speed reducer, wherein said step motor drives an output axle via a harmonic speed reducer.

15. An electric waving fan, as recited in claim 14, further comprising an electronic circuit for adjusting a waving speed and a waving range of said fan vane element, which comprises a step-motor control component for regulating said waving speed of said fan vane element, a waving direction control component for regulating said waving range, and a waving speed control component for regulating a back and forth waving speed, wherein said step motor is started by a driving integrated circuit C1 and a pulse distribution integrated circuit C2, wherein said driving integrated C1 is a power amplifying integrated circuit and said pulse distribution integrated circuit C2 is a step motor pulse distributor, wherein when a pulse signal source generated by a square wave generator C3 are transmitted to said pulse distribution integrated circuit C2, a three phase single six beat sequence pulse is produced at an output terminal of said pulse distribution integrated circuit C2 which, after being amplified, is used to drive said step motor to drive said fan vane element, moreover said speed control of said step motor is achieved by changing said frequency of said square wave generator C3 and said square wave generator C3 is composed of a ring oscillator, wherein by turning a potentiometer C31, a vibration frequency is changed so as to achieve a stepless control of said step motor.

16. An electric waving fan, as recited in claim 15, wherein controlling of said waving range of said fan vane element is achieved by means of a calculator C4, a preset data functional block C5 and a function block A/D C6, hand turning of a potentiometer C61 setting a parameter, by changing said parameter, preset data being outputted to said function block A/D C6, a comparator C7 reading and comparing data from said calculator C4 and said function block A/D C6, wherein when said data from said calculator are the same, said comparator C7 sends out a pulse which is time-expanded through a time-expand circuit C8, and then passed into a two-state trigger C9 to produce pulse from triggers output terminal to control a back and forth revolution of said pulse distribution integrated circuit C2, moreover said time-expanded pulse also is sent back to said calculator C4 to become a clear signal, wherein said calculator C4 clears zero and starts calculating from very beginning every time when said calculator C4 completes a calculation circle, wherein said waving range is preset by means of a digital switch to achieved preset data which are transmitted to said comparator C7 by turning said preset switch C10, via function block A/D C6, to achieve comparison control.

17. An electric waving fan, as recited in claim 2, wherein said engaging means includes a positioning crosspiece which is disposed at a lower portion of said outer body and extended laterally across said outer body and normal to said base axis, wherein two end portions of said positioning crosspiece are respectively disposed for travel in two opposing longitudinally arranged slots provided at said two parallel arms of said outer body, at least a compression spring being sit beneath said positioning crosspiece for pressing said positioning crosspiece into engagement with one of a series of radially aligned grooves formed on lower portions of said two opposing arms of said sleeve element, wherein by pulling said positioning crosspiece downwardly against a biasing force of said compression spring to disengage said positioning crosspiece from one pair of said aligned grooves on said opposing arms, said sleeve element is thus able to be pivotally turn with respect to said outer body so as to adjust a fanning position of said fan vane element, afterwards said positioning crosspiece is replaced in locking engagement with a pair of said aligned grooves at said lower portions of said opposing arms so as to secure said sleeve element in said newly adjusted fanning position.

18. An electric waving fan, as recited in claim 17, wherein said output assembly comprises a core support having a forward end which has two cylindrical recesses, each of said recesses having a longitudinal axis arranged normal to a longitudinal axis of said core support that is parallel to said base axis, a gear transmission half axle mounted in one of said cylindrical recesses while a half axle transmission supporting cylinder is mounted and secured in said another cylindrical recess, said gear transmission half axle and half axle transmission supporting cylinder supporting a transmission junction core which is a revolving fan handle chassis having a longitudinal axis coincident with said longitudinal axis of said core support, said gear transmission half axle having a first array of teeth provided thereon in circular manner that engages said transmission junction core, a second array of gear teeth is borne by a surface of said half axle transmission supporting cylinder, wherein under pressure from a plate shaped spring element, a cage that supports said gear transmission half axle pushes said transmission junction core toward said gear transmission half axle, and said gear teeth on said gear transmission half axle and said revolving fan handle chassis function as a gear clutch.

19. An electric waving fan, as recited in claim 17, wherein said transmission apparatus comprises a driving rocker coupled to said induction motor through a speed reducer for slowing down a speed of said motor so that said driving rocker can be driven in slow circulating motion, wherein said driving rocker includes a shaft connected to a pitman, which in turn is connected to a driven rocker, said driving rocker having a first length and said driven rocker having a second length greater than a radius between a crank rod of said driving rocker and a center thereof, where said first and second lengths are comparatively set to a ratio such that when said driving rocker makes a revolving movement, said driven rocker makes a fan shaped movement, moreover said driven rocker is connected to an output axle member and drives, via a gear clutch, said fan vane element to make fanning movements.

20. An electric waving fan, as recited in claim 19, wherein said output assembly comprises a core support having a forward end which has two cylindrical recesses, each of said recesses having a longitudinal axis arranged normal to a longitudinal axis of said core support that is parallel to said base axis, a gear transmission half axle mounted in one of said cylindrical recesses while a half axle transmission supporting cylinder is mounted and secured in said another cylindrical recess, said gear transmission half axle and half axle transmission supporting cylinder supporting a transmission junction core which is a revolving fan handle chassis having a longitudinal axis coincident with said longitudinal axis of said core support, said gear transmission half axle having a first array of teeth provided thereon in circular manner that engages said transmission junction core, a second array of gear teeth is borne by a surface of said half axle transmission supporting cylinder, wherein under pressure from a plate shaped spring element, a cage that supports said gear transmission half axle pushes said transmission junction core toward said gear transmission half axle, and said gear teeth on said gear transmission half axle and said revolving fan handle chassis function as a gear clutch.

21. An electric waving fan, as recited in claim 1, wherein said transmission apparatus comprises a driving rocker coupled to said induction motor through a speed reducer for slowing down a speed of said motor so that said driving rocker can be driven in slow circulating motion, wherein said driving rocker includes a shaft connected to a pitman, which in turn is connected to a driven rocker, said driving rocker having a first length and said driven rocker having a second length greater than a radius between a crank rod of said driving rocker and a center thereof, where said first and second lengths are comparatively set to a ratio such that when said driving rocker makes a revolving movement, said driven rocker makes a fan shaped movement, moreover said driven rocker is connected to an output axle member and drives, via a gear clutch, said fan vane element to make fanning movements.

22. An electric waving fan, as recited in claim 21, wherein said output assembly comprises a core support having a forward end which has two cylindrical recesses, each of said recesses having a longitudinal axis arranged normal to a longitudinal axis of said core support that is parallel to said base axis, a gear transmission half axle mounted in one of said cylindrical recesses while a half axle transmission supporting cylinder is mounted and secured in said another cylindrical recess, said gear transmission half axle and half axle transmission supporting cylinder supporting a transmission junction core which is a revolving fan handle chassis having a longitudinal axis coincident with said longitudinal axis of said core support, said gear transmission half axle having a first array of teeth provided thereon in circular manner that engages said transmission junction core, a second array of gear teeth is borne by a surface of said half axle transmission supporting cylinder, wherein under pressure from a plate shaped spring element, a cage that supports said gear transmission half axle pushes said transmission junction core toward said gear transmission half axle, and said gear teeth on said gear transmission half axle and said revolving fan handle chassis function as a gear clutch.

23. An electric waving fan, as recited in claim 1, wherein said output assembly comprises a core support having a forward end which has two cylindrical recesses, each of said recesses having a longitudinal axis arranged normal to a longitudinal axis of said core support that is parallel to said base axis, a gear transmission half axle mounted in one of said cylindrical recesses while a half axle transmission supporting cylinder is mounted and secured in said another cylindrical recess, said gear transmission half axle and half axle transmission supporting cylinder supporting a transmission junction core which is a revolving fan handle chassis having a longitudinal axis coincident with said longitudinal axis of said core support, said gear transmission half axle having a first array of teeth provided thereon in circular manner that engages said transmission junction core, a second array of gear teeth is borne by a surface of said half axle transmission supporting cylinder, wherein under pressure from a plate shaped spring element, a cage that supports said gear transmission half axle pushes said transmission junction core toward said gear transmission half axle, and said gear teeth on said gear transmission half axle and said revolving fan handle chassis function as a gear clutch.

* * * * *